US010270160B2

(12) United States Patent
Tatarnikov et al.

(10) Patent No.: US 10,270,160 B2
(45) Date of Patent: Apr. 23, 2019

(54) ANTENNA RADOMES FORMING A CUT-OFF PATTERN

(71) Applicant: Topcon Positioning Systems, Inc., Livermore, CA (US)

(72) Inventors: Dmitry Vitalievich Tatarnikov, Moscow (RU); Alexey Anatolievich Generalov, Moscow (RU); Ivan Miroslavovich Chernetskiy, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 315 days.

(21) Appl. No.: 15/124,071

(22) PCT Filed: Apr. 27, 2016

(86) PCT No.: PCT/RU2016/000251
§ 371 (c)(1),
(2) Date: Sep. 7, 2016

(87) PCT Pub. No.: WO2017/188837
PCT Pub. Date: Nov. 2, 2017

(65) Prior Publication Data

US 2018/0159210 A1 Jun. 7, 2018

(51) Int. Cl.
*H01Q 1/42* (2006.01)
*H01Q 19/02* (2006.01)
(Continued)

(52) U.S. Cl.
CPC ..... *H01Q 1/42* (2013.01); *H01Q 1/422* (2013.01); *H01Q 1/425* (2013.01);
(Continued)

(58) Field of Classification Search
CPC ..... H01Q 1/42; H01Q 1/422; H01Q 15/0013; H01Q 15/002; H01Q 15/148; H01Q 15/24
See application file for complete search history.

(56) References Cited

U.S. PATENT DOCUMENTS 4,287,520 A * 9/1981 Van Vliet ..... H01Q 15/0013 343/754
4,797,683 A * 1/1989 Kosowsky ..... H01Q 1/42 343/705

(Continued)

OTHER PUBLICATIONS

Search Report in PCT/RU2016/000251, dated Jan. 23, 2017.

*Primary Examiner* — Dameon E Levi
*Assistant Examiner* — Ab Salam Alkassim, Jr.
(74) *Attorney, Agent, or Firm* — Bardmesser Law Group

(57) ABSTRACT

An antenna system includes a circularly-polarized antenna element with a Down/Up ratio in a proximity of a local horizon of no better than −12 dB. An antenna radome encloses the antenna element, the radome providing a drop of antenna pattern near a local horizon and having an upper transparent area and a lower semi-transparent area. The semi-transparent area is has a generally hemispherical shape. The semi-transparent area includes a circular metallized portion with vertical and horizontal slots, the metallized portion extending part of the way downward from an equator of the generally hemispherical shape. The metallized portion includes passive discrete electrical elements connected across at least some of the slots. The metallized portion can include multiple areas having different degrees of transparence. Each such area has a specified impedance. The discrete elements are capacitors, inductors and/or resistors. The metallized portion can have a plurality of circular rows separated by the horizontal slots.

11 Claims, 15 Drawing Sheets

(51) Int. Cl.
*H01Q 15/00* (2006.01)
*H01Q 19/06* (2006.01)
*H01Q 9/04* (2006.01)

(52) U.S. Cl.
CPC ..... *H01Q 15/006* (2013.01); *H01Q 19/021* (2013.01); *H01Q 19/06* (2013.01); *H01Q 9/0428* (2013.01)

(56) References Cited

U.S. PATENT DOCUMENTS 5,162,809 A * 11/1992 Wu ..... H01Q 15/0033 343/753
5,652,631 A * 7/1997 Bullen ..... H01Q 1/281 343/753
6,323,825 B1 * 11/2001 Zidek ..... H01Q 1/422 343/753
6,836,247 B2 * 12/2004 Soutiaguine ..... H01Q 9/0414 343/700 MS
7,068,234 B2 * 6/2006 Sievenpiper ..... H01Q 3/26 343/745
7,173,565 B2 * 2/2007 Sievenpiper ..... H01Q 15/24 343/700 MS
7,193,573 B2 3/2007 Durso et al.
7,245,269 B2 * 7/2007 Sievenpiper ..... H01Q 3/46 343/700 MS
7,554,499 B2 * 6/2009 Munk ..... H01Q 1/421 343/704
7,557,769 B2 * 7/2009 Picard ..... G02B 5/207 343/872
7,649,505 B2 1/2010 Schadler
7,868,829 B1 * 1/2011 Colburn ..... H01Q 3/46 343/700 MS
8,036,594 B2 10/2011 Schadler
8,081,137 B2 * 12/2011 Chang ..... H01Q 1/422 343/872
8,174,450 B2 * 5/2012 Tatarnikov ..... H01Q 9/0407 343/700 MS
8,339,320 B2 * 12/2012 Sievenpiper ..... H01Q 15/002 342/1
8,373,597 B2 2/2013 Schadler
8,441,409 B2 * 5/2013 Tatarnikov ..... H01Q 15/16 343/700 MS
9,123,998 B1 * 9/2015 LoRe ..... H01Q 1/424
9,231,299 B2 * 1/2016 Jordan ..... H01Q 1/425
9,466,887 B2 * 10/2016 Gregoire ..... H01Q 3/46
9,520,651 B2 * 12/2016 Astakhov ..... H01Q 1/48
9,548,531 B2 * 1/2017 Schoenlinner ..... H01Q 15/141
9,564,681 B2 * 2/2017 Cordone ..... H01Q 1/42
9,653,815 B2 * 5/2017 Liu ..... H01Q 15/0006
9,702,978 B2 * 7/2017 Tatarnikov ..... H01Q 15/168
9,806,410 B2 * 10/2017 Tatarnikov ..... H01Q 15/0013
9,917,369 B2 * 3/2018 Stepanenko ..... H01Q 1/28
10,050,340 B2 * 8/2018 Merk ..... H01Q 1/288
10,153,546 B2 * 12/2018 Kolak ..... H01Q 1/422
2002/0167456 A1 * 11/2002 McKinzie, III ..... H01Q 3/46 343/909
2003/0214456 A1 * 11/2003 Lynch ..... H01Q 15/0026 343/909
2005/0179614 A1 * 8/2005 Nagy ..... H01Q 3/24 343/909
2006/0114170 A1 * 6/2006 Sievenpiper ..... H01Q 15/24 343/909
2009/0109115 A1 * 4/2009 Dittrich ..... H01Q 1/422 343/841
2011/0030757 A1 * 2/2011 Lin ..... H01L 31/022433 136/244
2011/0163930 A1 * 7/2011 De Lustrac ..... H01Q 15/148 343/777
2012/0098628 A1 * 4/2012 Batchelor ..... H01Q 15/0066 333/24 C
2012/0154241 A1 * 6/2012 Tatarnikov ..... H01Q 15/0013 343/848
2013/0222200 A1 * 8/2013 Ju ..... H01Q 15/02 343/833
2014/0118217 A1 * 5/2014 Cannon ..... H01Q 1/425 343/872
2014/0118218 A1 * 5/2014 Jordan ..... H01Q 1/425 343/872
2015/0015451 A1 * 1/2015 Tatarnikov ..... H01Q 1/48 343/848
2015/0130671 A1 * 5/2015 Cordone ..... H01Q 1/42 343/705
2015/0255877 A1 * 9/2015 Liu ..... H01Q 15/0006 343/909
2016/0252621 A1 * 9/2016 Astakhov ..... H01Q 1/48 342/357.61
2016/0268691 A1 * 9/2016 Tatarnikov ..... H01Q 1/48
2017/0201017 A1 * 7/2017 Cordone ..... H01Q 1/42
2017/0237159 A1 * 8/2017 Tatarnikov ..... H01Q 1/48 343/848
2017/0358863 A1 * 12/2017 Stepanenko ..... H01Q 1/28
2017/0363747 A1 * 12/2017 Tatarnikov ..... G01S 19/03
2018/0017664 A1 * 1/2018 Toyao ..... H01Q 15/0066

* cited by examiner

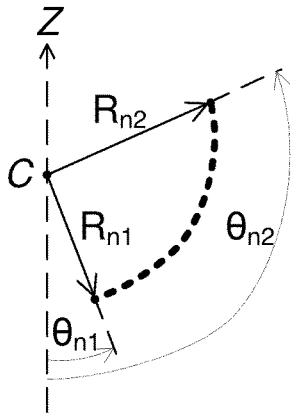
FIG. 2A
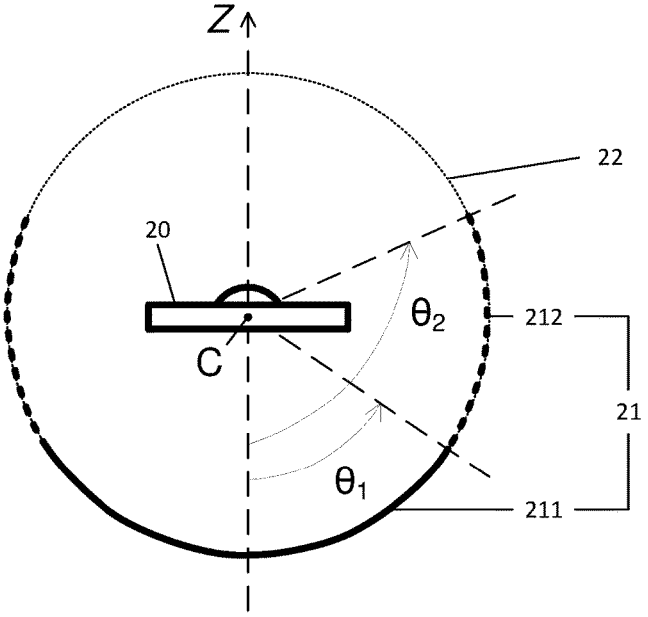
FIG. 2B
FIG. 2C
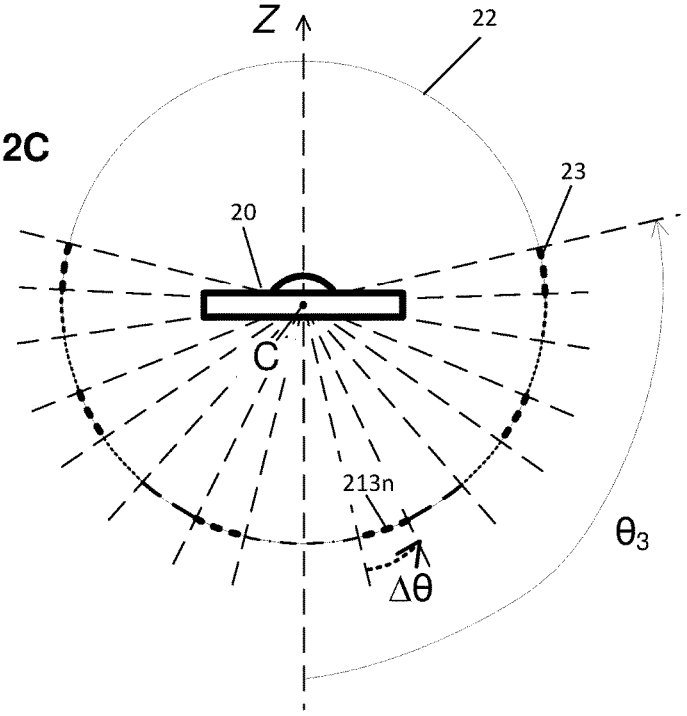

ANTENNA RADOMES FORMING A CUT-OFF PATTERN

BACKGROUND OF THE INVENTION

Field of the Invention

This invention relates to antennas and antenna radomes.

Description of the Related Art

Global navigation satellite systems (GNSS) are widely used for high-precision positioning, such as the US Global Positioning System (GPS) and Russian global navigation system GLONASS, as well as some others. A GNSS antenna has to provide signal reception in the entire GNSS range, namely, a low-frequency band 1164-1300 MHz and a high-frequency band 1525-1610 MHz.

One of the most important positioning errors in GNSS systems is a so-called multipath error, when a signal reflected from the underlying ground surface appears at the input of the receiving antenna along with the line-of-sight signal.

The value of the multipath error is proportional to the ratio $$DU(\theta) = \frac{F(-\theta)}{F(\theta)}$$

This ratio is normally called the Down/Up ratio. In this ratio, θ is the elevation angle over the local horizon, and F(+/−θ) is the antenna pattern (AP) value at angle θ above and under the local horizon (θ=0°) correspondingly (relative to a maximum, and usually measured in dB). A spatial region where θ>0 is the upper or front hemisphere, otherwise, a spatial region at θ<0 is called the lower or backward hemisphere.

To provide a stable and reliable operation of positioning systems, quality signal reception from all satellites over the local horizon is required. The value F(θ) in the upper hemisphere should not vary highly. At the same time, the value F(θ) in the lower hemisphere should be as small as possible. So the value F(θ) should have a sharp drop in the vicinity of the local horizon (i.e., near θ=0°).

Receiving antennas thus need to provide such an AP whose level varies negligibly in the upper hemisphere, sharply drops when crossing the direction to the local horizon, and is small in the lower hemisphere. Also, such an antenna pattern needs to be provided over entire operational frequency range.

SUMMARY OF THE INVENTION

Accordingly, the present invention is directed to antenna radomes with cut-off patterns that substantially obviate one or more of the disadvantages of the related art.

An antenna system with a pattern whose level varies slightly in the upper hemisphere, drops in the direction of the local horizon, and is small in the lower hemisphere, over the entire desired frequency range. The antenna system includes a circularly-polarized antenna element placed inside a radome. The antenna element is to have a Down/Up ratio in a proximity of a local horizon of no better than −12 dB (The radome consists of some parts made from materials with different transparency. The basis of the proposed invention is a phenomenon of interference of the passed and diffractive fields in the shadow area, which has been formed by radome's semi-transparent surface. Due to using semi-transparent materials, one can control field interference, thereby shaping a desired antenna pattern for the proposed antenna system.

In another embodiment, there is provided an antenna system with a circularly-polarized antenna element with a Down/Up ratio in a proximity of a local horizon of no better than −12 dB, and an antenna radome providing a drop of antenna pattern near a local horizon and having transparent and semi-transparent areas, the transparent area being above the semi-transparent area. Optionally, the semi-transparent area contains multiple parts having different degrees of transparence. Optionally, each part of the semi-transparent area includes a set of slots with a specified impedance. Optionally, the semi-transparent area can comprise a set of vertical slots and a set of horizontal slots. Optionally, the radome includes a plurality of discrete elements providing the specified impedance. Optionally, the discrete elements include any of capacitors, inductors, resistors, connected in series and/or in parallel. Optionally, the semi-transparent area has a plurality of layers, each layer having a set of vertical slots and a set of horizontal slots.

In another embodiment, there is provided an antenna system includes a circularly-polarized antenna element with a Down/Up ratio in a proximity of a local horizon of no better than −12 dB, and an antenna radome enclosing the antenna element, the radome providing a drop of antenna pattern near a local horizon and having an upper transparent area and a lower semi-transparent area, The semi-transparent area is has a generally hemispherical shape, the semi-transparent area includes a circular metallized portion with vertical and horizontal slots, the metallized portion extending part of the way downward from an equator of the generally hemispherical shape, The metallized portion includes passive discrete elements connected across at least some of the slots. The metallized portion has a plurality of circular rows separated by the horizontal slots. Optionally, wherein the metallized portion includes multiple areas having different degrees of transparence. Optionally, each area of the metallized portion has a specified impedance. Optionally, the discrete elements include any of capacitors, inductors, resistors, connected in series and/or in parallel.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

In the drawings:

FIG. 2A shows designations used in the text.

FIGS. 2B-2C schematically show one of embodiments for antenna system design.

Figure 1:
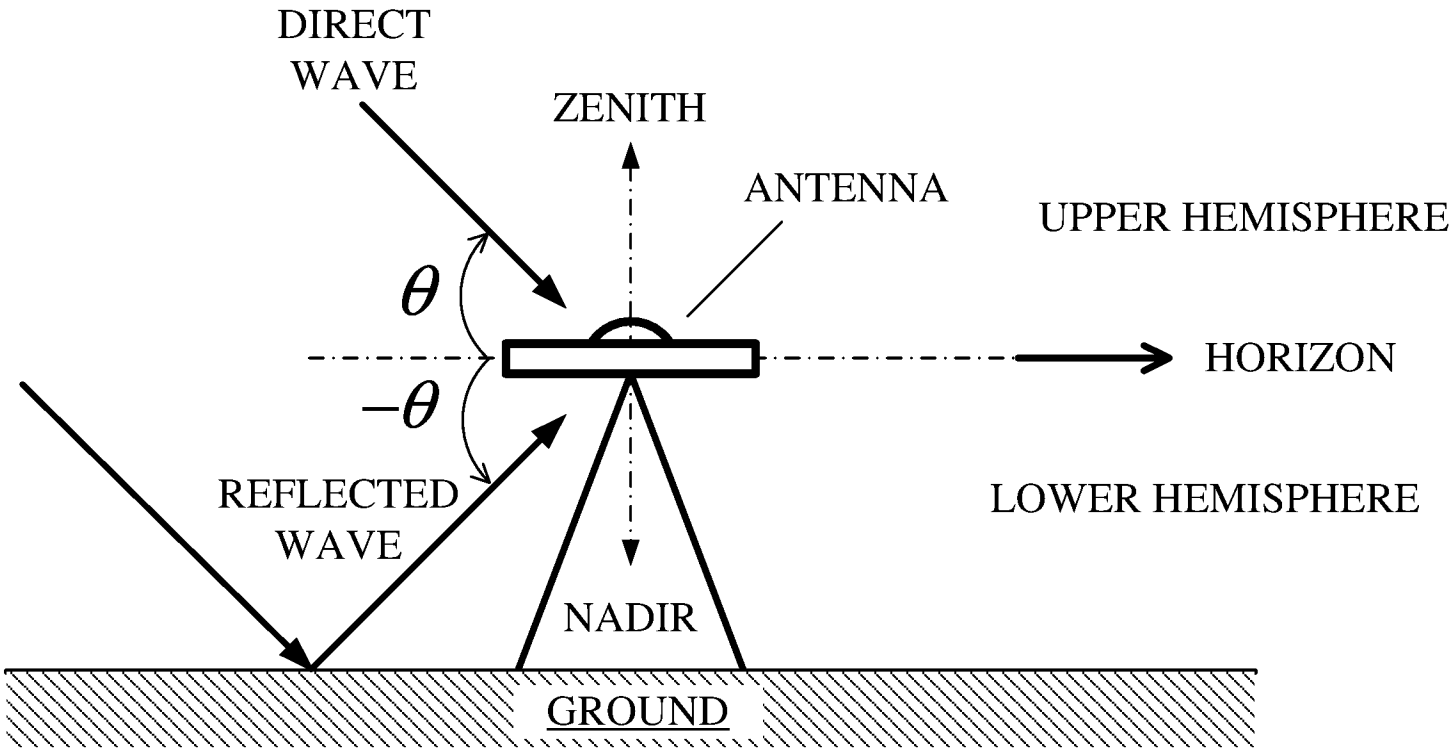
FIG. 1 shows a conditional space division into upper and lower hemispheres and a conditional view of incident and reflected waves.
Figure 3A:
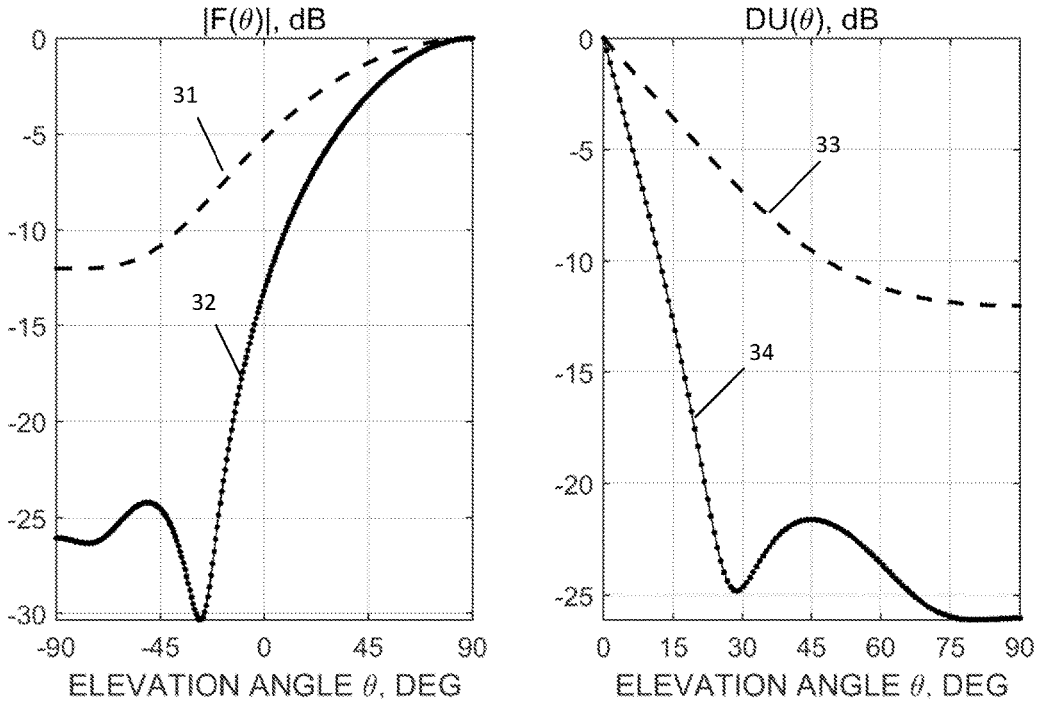
Figure 3B:
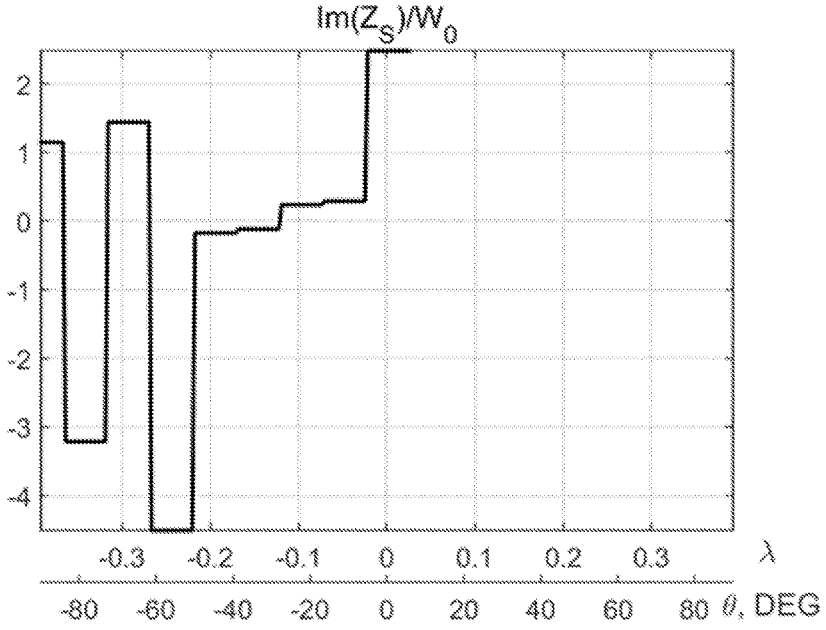

FIGS. 3A-3B show graphs $|F(\theta)|$ and $DU(\theta)$ for a surface radius of $R=0.25\lambda$, and corresponding impedance distribution along the surface.

Figure 4A:
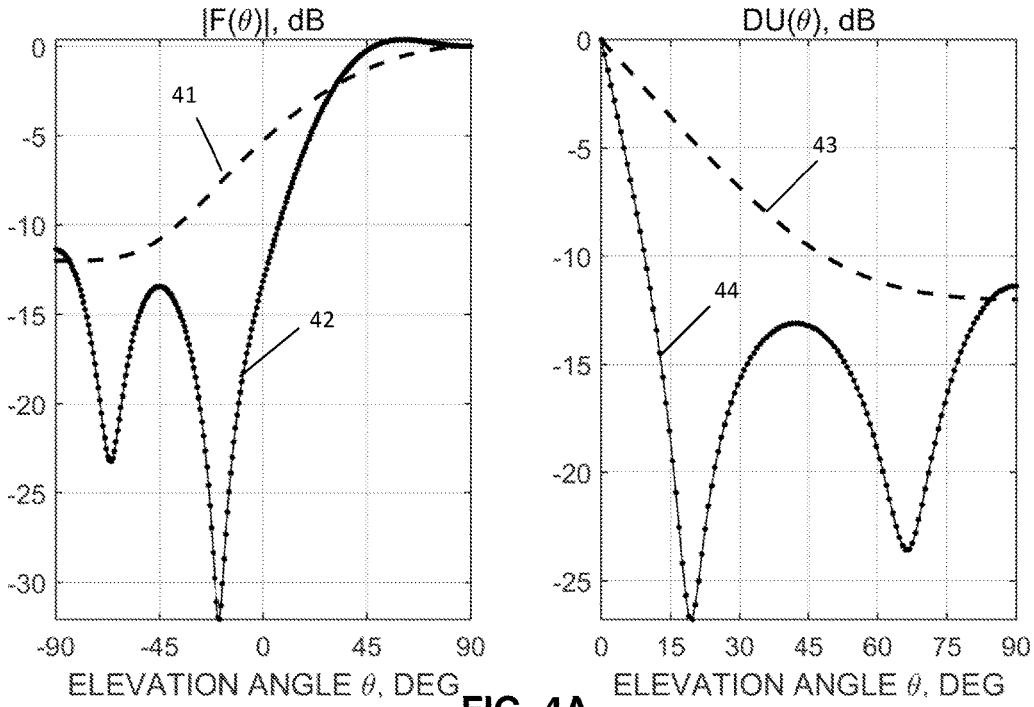
Figure 4B:
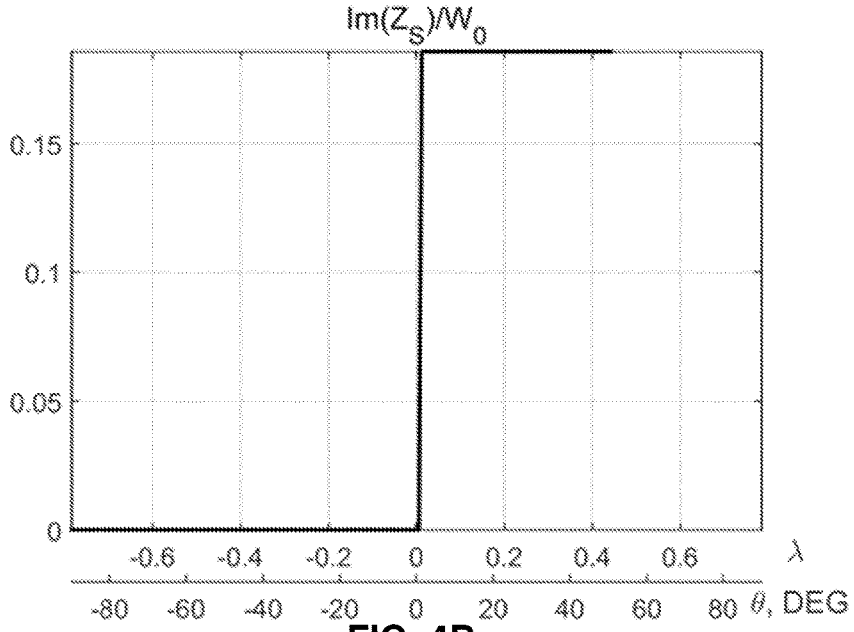

FIGS. 4A-4B show graphs $|F(\theta)|$ and $DU(\theta)$ for a surface radius of $R=0.5\lambda$, and corresponding impedance distribution along the surface.

Figure 5A:
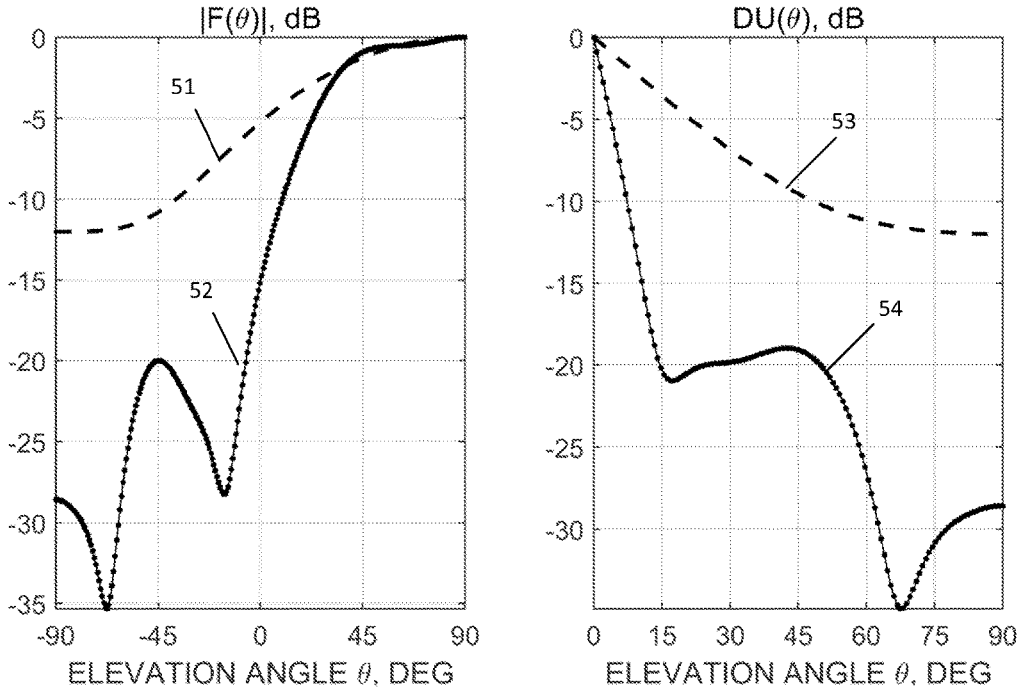
Figure 5B:
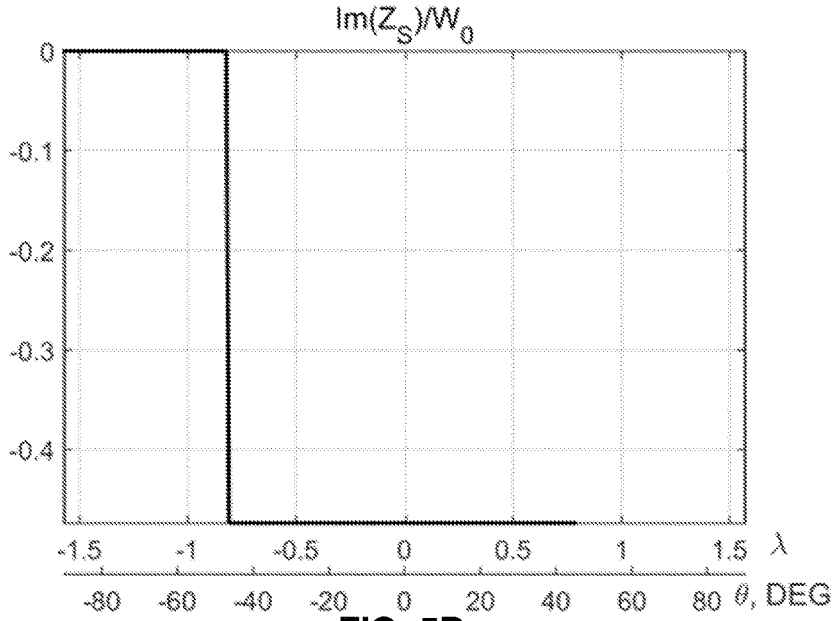

FIGS. 5A-5B show graphs $|F(\theta)|$ and $DU(\theta)$ for a surface radius of $R=\lambda$ and corresponding impedance distribution along the surface.

Figure 6A:
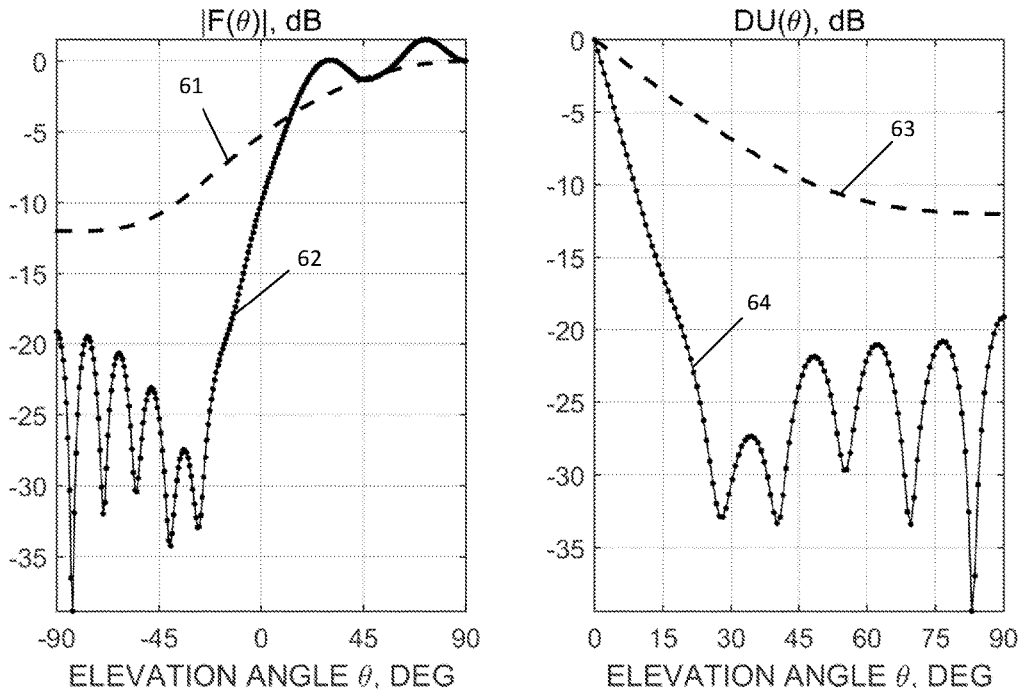
Figure 6B:
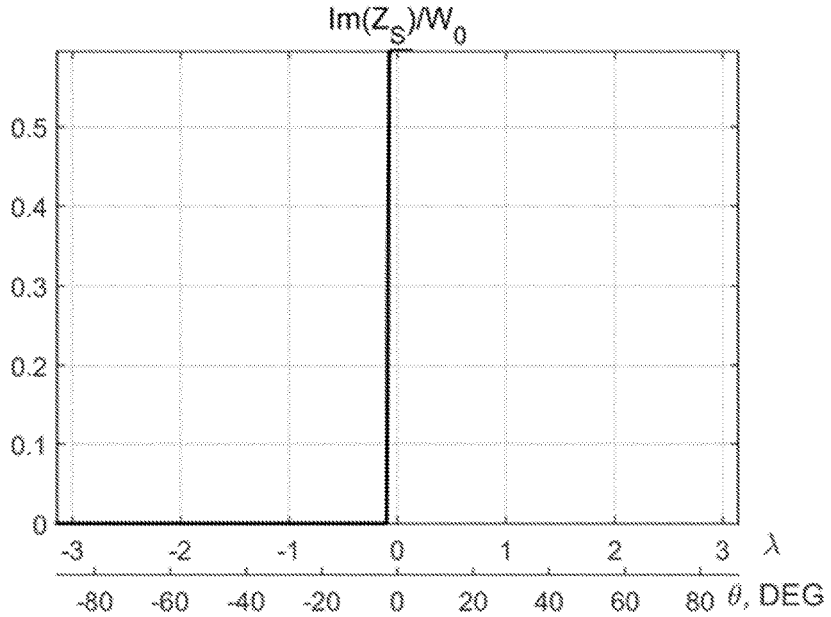

FIG. 6A-6B show graphs $|F(\theta)|$ and $DU(\theta)$ for a surface radius of $R=2\lambda$ and a variant of corresponding impedance distribution along the surface accordingly.

Figure 7A:
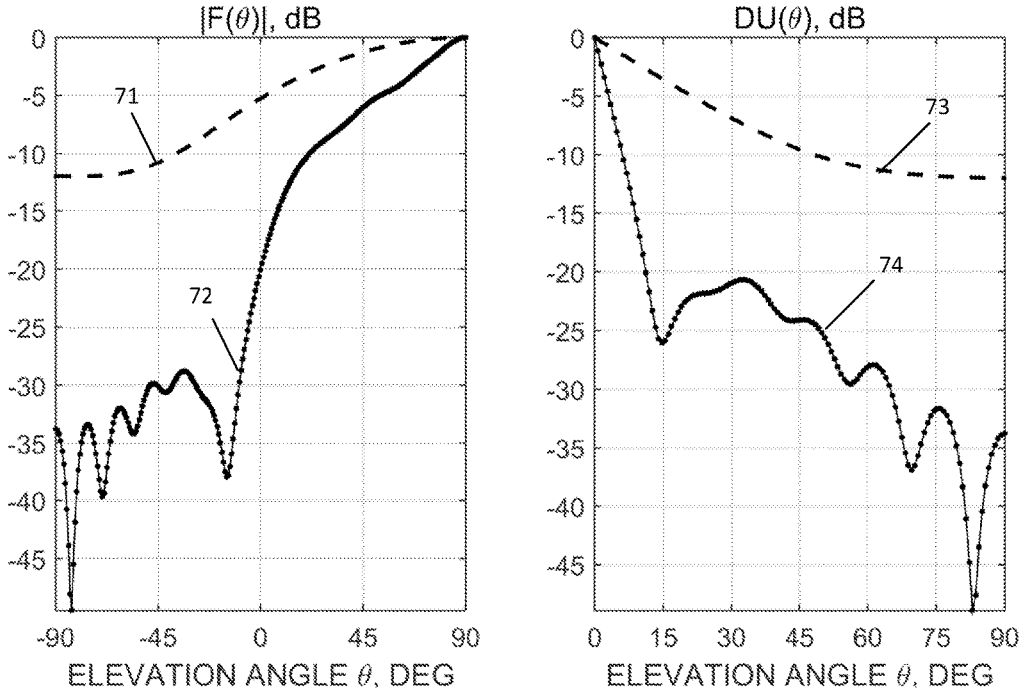
Figure 7B:
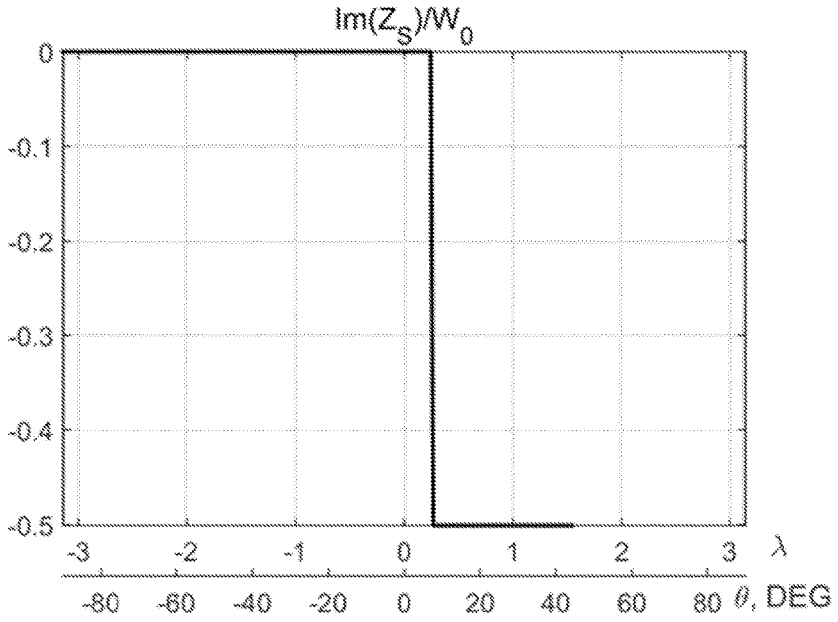

FIGS. 7A-7B shows graphs $|F(\theta)|$ and $DU(\theta)$ for a surface radius of $R=2\lambda$, and another variant of corresponding impedance distribution along the surface accordingly.

Figure 8A:
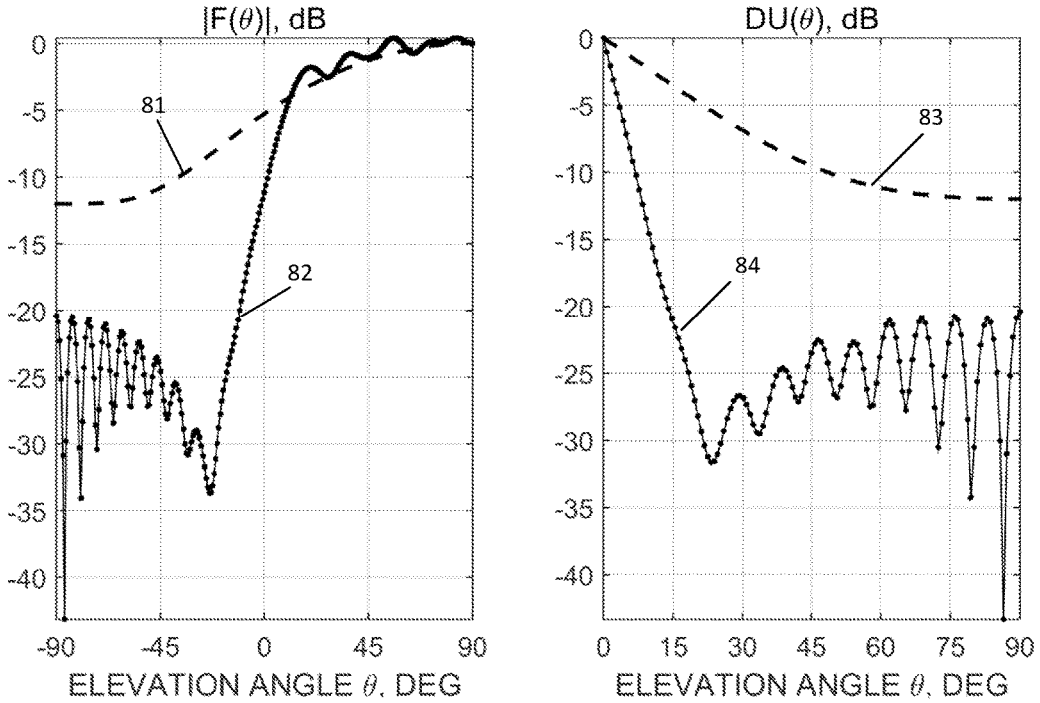
Figure 8B:
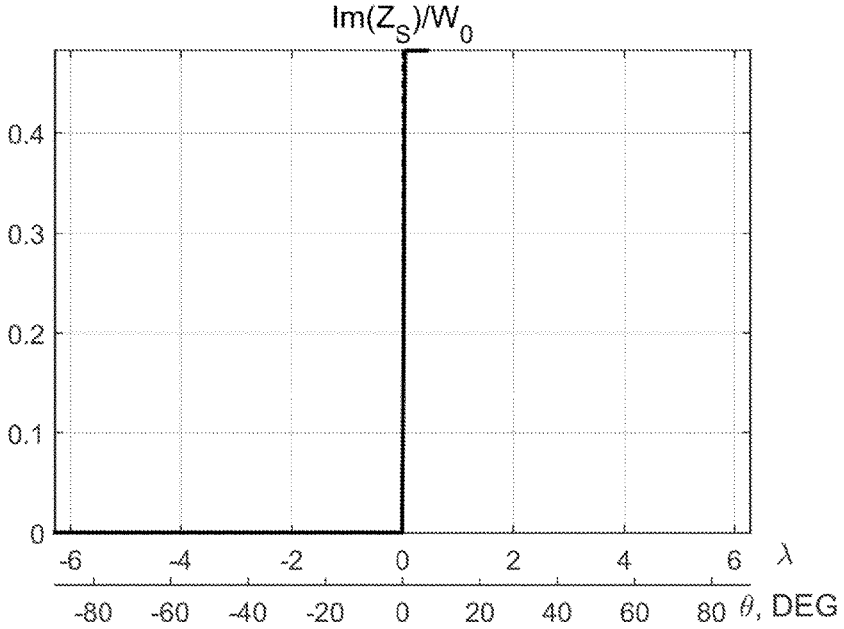

FIGS. 8A-8B show graphs $|F(\theta)|$ and $DU(\theta)$ for a surface radius of $R=4\lambda$ and corresponding impedance distribution along the surface.

Figure 9:
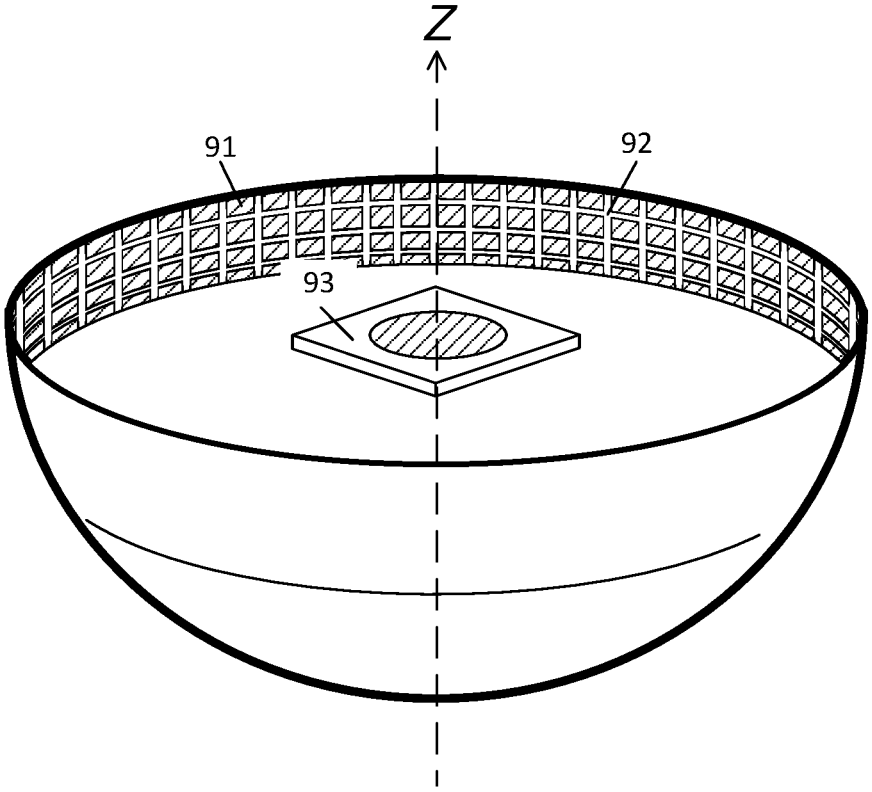

FIG. 9 schematically shows one of the embodiments of the radome design.

Figure 10A:
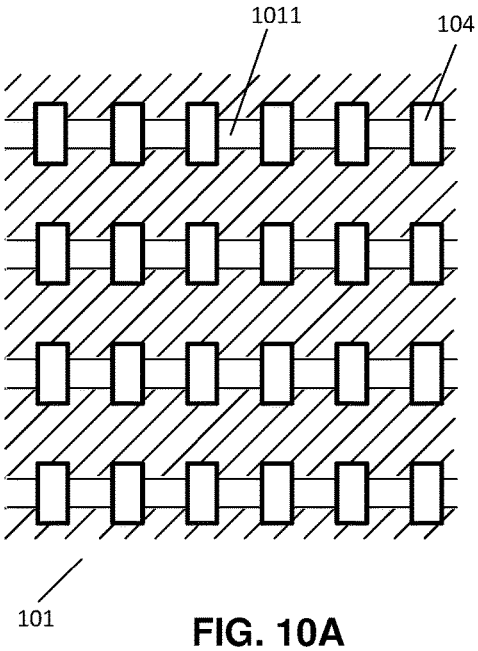
Figure 10B:
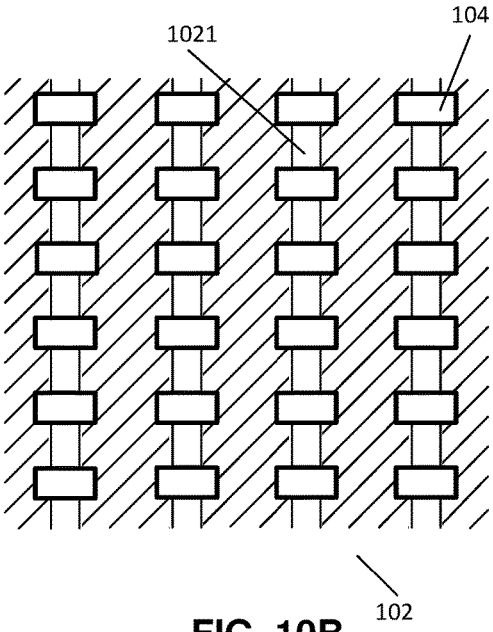
Figure 10C:
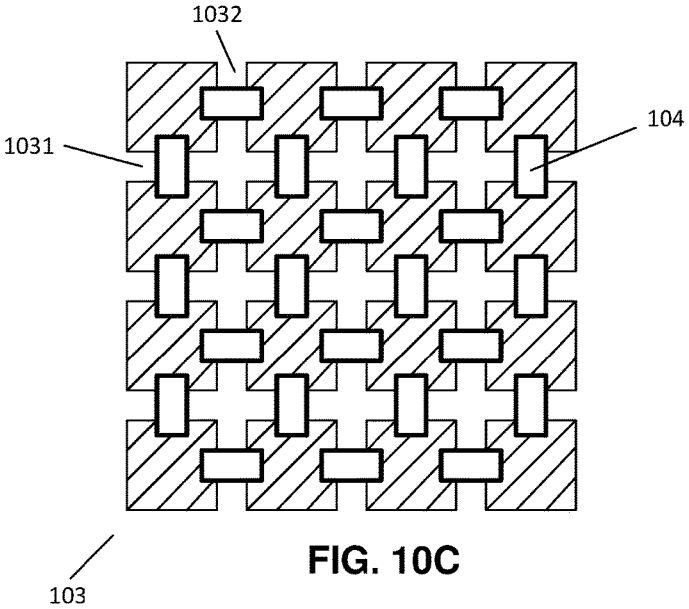

FIGS. 10A-10C show a schematic view of implementing semi-transparent surface.

FIGS. 11A-11G show a schematic view of embodiments for elements with user defined impedance.

Figure 12:
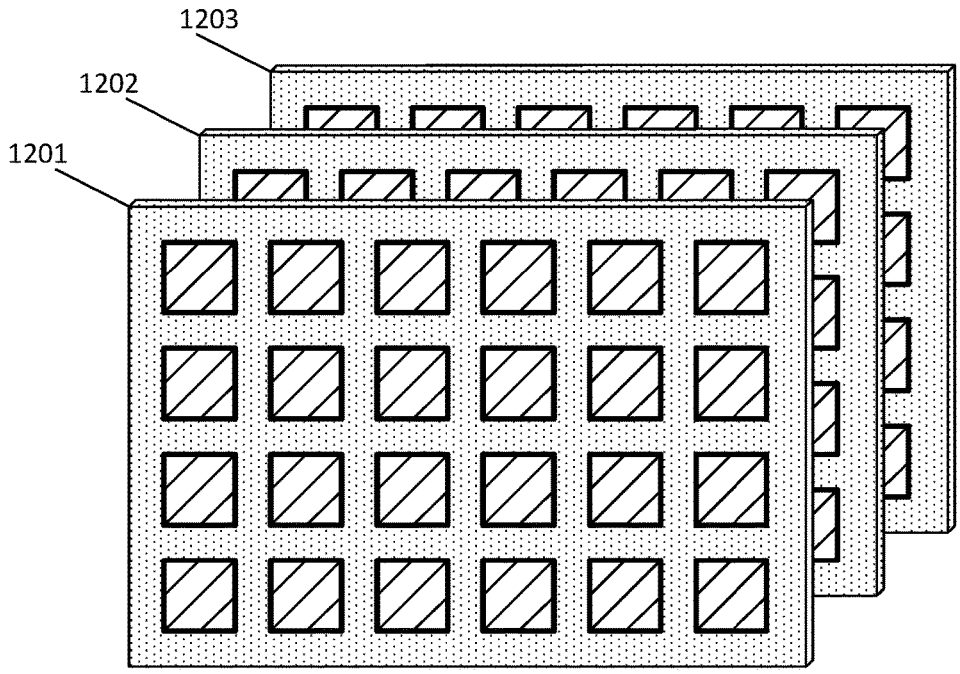

FIG. 12 shows a schematic structure of one embodiment for multilayer semi-transparent surface.

Figure 13:
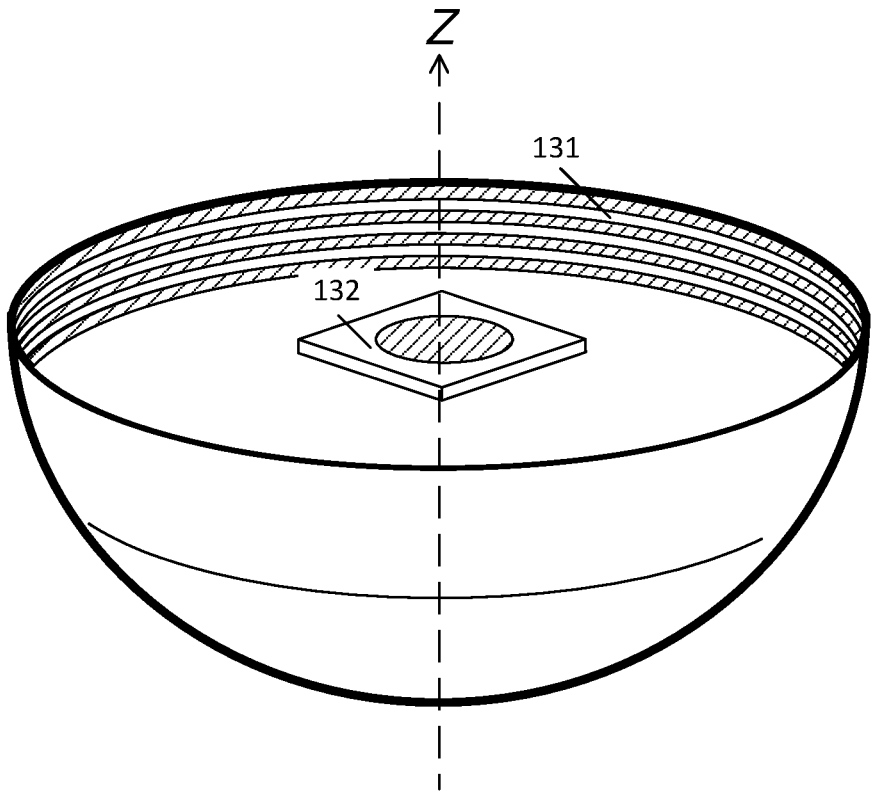
Figure 14:
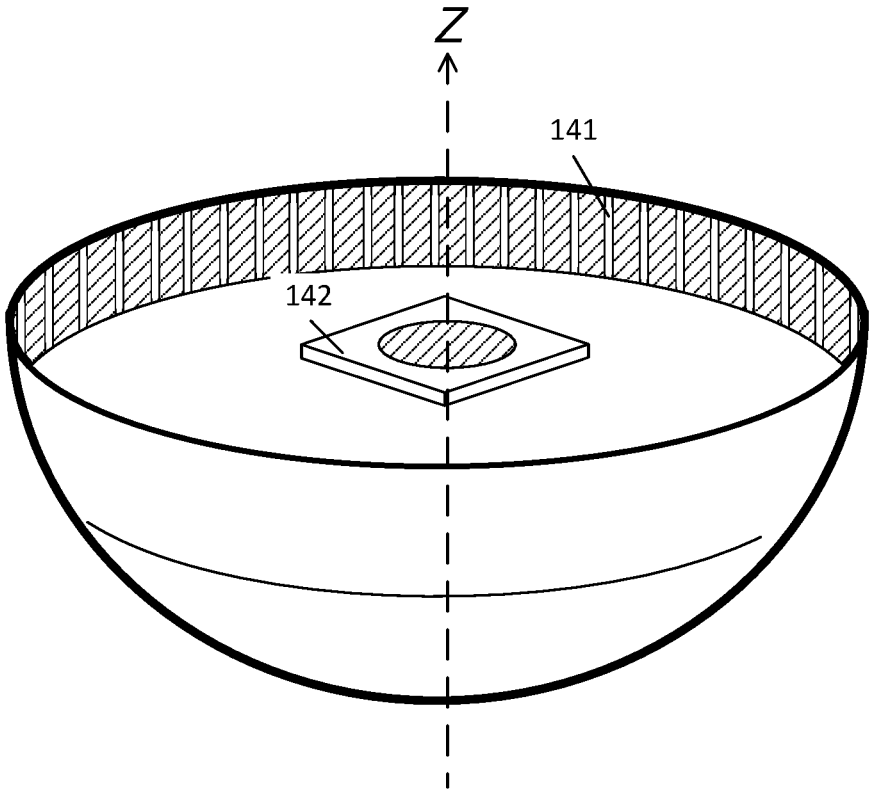

FIG. 13 shows an embodiments for antenna system design having only horizontal slots FIG. 14 shows an embodiments for antenna system design having only vertical slots.

Figure 15:
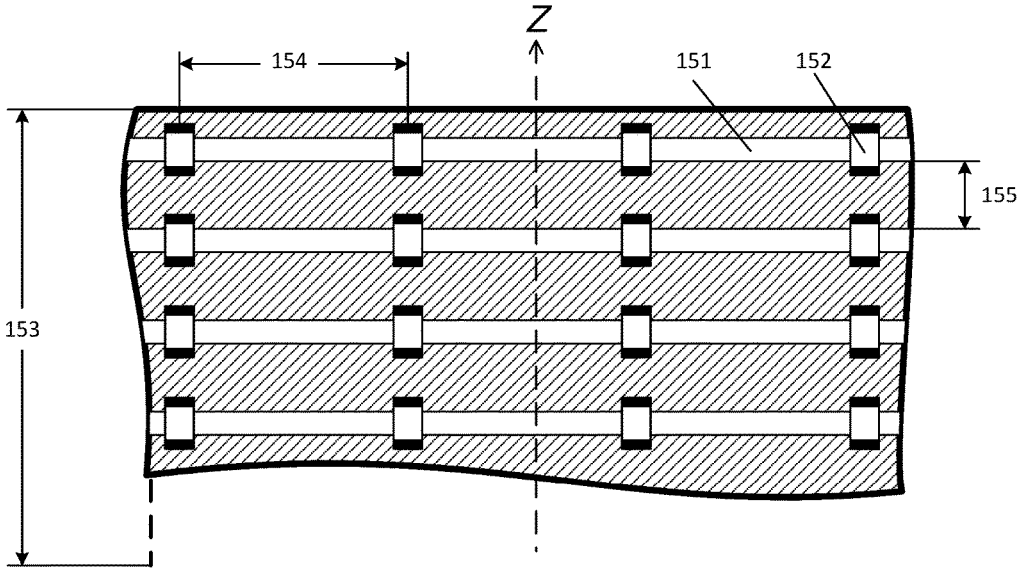

FIG. 15 shows a schematic view of a segment of semi-transparent surface

DETAILED DESCRIPTION OF THE PREFERRED EMBODIMENTS

Reference will now be made in detail to the preferred embodiments of the present invention, examples of which are illustrated in the accompanying drawings.

As shown in FIG. 2B, the proposed antenna system consists of an antenna 20 and radome 21. Radome design has a symmetry relative to the vertical axis Z passing through center C of the antenna system.

The radome includes two segments—a semi-transparent segment 21 and transparent segment 22. The semi-transparent segment 21 is made of semi-transparent material. Semi-transparency here means the property of partial reflection and partial passing-through of electromagnet radiation. Numerical characteristics of such materials and a method of their implementation is given below. The transparent segment 22 is made of radio-transparent material, for example, thin dielectric with permeability close to 1. The transparent segment 22 is located above the semi-transparent one 21.

According to FIG. 2C, the semi-transparent segment in turn includes a set of parts. Each part of the semi-transparent segment differs from other parts in a user-defined capability of passing-through and reflecting electromagnetic waves and is situated on a surface formed by rotation an arc about the vertical axis Z. FIG. 2A shows that each arc has its starting and ending point. The starting point is characterized by distance $R_{n1}$ from the radome center C and angle $\theta_{n1}$ being counted from the vertical axis Z. The ending point is characterized by distance $R_{n2}$ from the radome center C and angle $\theta_{n2}$ counted from the vertical axis Z. The starting arc point with number n+1 matches the ending arc point with number n. Here, n is the number of the corresponding part. Note that arcs can be both convex and concave.

A spherically shaped embodiment of the radome design is further described. A semi-transparent segment of the radome is a part of a sphere with radius R and center at point C. It includes two parts. The first part—211—is formed by an arc starting from the vertical axis and characterized by radius R and angle $\theta_1$. This part is made of nontransparent material that fully reflects or partly absorbs (with an angular dependency) electromagnetic radiation.

The second part of the semi-transparent segment 212 is formed by an arc of radius R, which starts at angle $\theta_1$ and ends at angle $\theta_2$. Angular dimension of the arc is $\theta_2-\theta_1$. Angle $\theta_2$ can take values greater than or equal to $\theta_1$. If the angles are the same, there is no semi-transparent surface in the design.

A transparent segment of the radome design 22 is located on an arc, which, together with the arcs of the semi-transparent segment 21, form a half of circle such that a sphere can be formed by rotating said arcs about the vertical axis. The segment is made of radio-transparent material. A criterion of referring to transparent, semi-transparent and nontransparent quality of a surface is given below.

Interaction of electromagnetic waves with semi-transparent surfaces can be characterized by a parameter called the layer impedance and designated by $Z_S$. The impedance can be presented in the form of a sum $Z_S=R_S+iX_S$, where $R_S$, $X_S$ are active and reactive parts correspondingly. At $X_S>0$ impedance is inductive. At $X_S<0$, the impedance is capacitive. Components $R_S$, $X_S$ are conveniently measured in relative units, fractions of the universal constant $W_0=120\pi$ Ohm (which is the free-space characteristic impedance). When $|Z_S|>>W_0$, the surface can be regarded as fully transparent. When $|Z_S|<<W_0$ the surface is regarded as nontransparent, fully reflecting electromagnetic waves similar to metals. When $R_S\neq 0$, the surface partly absorbs electromagnetic waves. By selecting the desired layer impedance one can provide a required degree of passing electromagnetic radiation, its reflection and absorption, thereby affecting the interference mode of fields being passed-through and diffracted. When $|Z_S|\sim W_0$, the surface is considered semi-transparent.

Antennas used in satellite positioning operate mainly in receiving mode, but in many cases it is practical to consider their characteristics in passing-through mode. The identity of antenna characteristics both in receiving and passing-through modes is proved by the reciprocity principle.

Calculations were done for a two-dimensional problem of diffracting a source field on a cylindrical surface of a certain radius R. The radiation of the source was assumed to be uniform in the range of angles $\geq 0$, and in the range of $\theta<0$ the radiation was suppressed. AP and Down/Up ratio for such a source are presented in FIGS. 3A-8A by dotted lines 31, 33, 41, 43, 51, 53, 61, 63, 71, 73, 81, 83, which correspond to typical positioning AP. The obtained layer impedance distributions for surface radii $$\frac{R}{\lambda} = 0.25;\ 0.5;\ 1.0;\ 4.0$$

are given in FIGS. 3B, 4B, 5B, 8B, correspondingly. For $R=2\lambda$ there are given distributions in FIGS. 6B, 7B. FIGS. 3A-8A show antenna patterns and Down/Up ratios for the obtained impedance distributions with solid lines 32, 34, 42, 44, 52, 54, 62, 64, 72, 74, 82, 84.

Radome design shown in FIG. 2B does not allow for a considerable improvement in characteristics for small surface radii ($R<\lambda$), hence a periodically-variable surface distribution is proposed which corresponds to a semi-transparent surface 23 with segments 213*n* and angle arc of $\Delta\theta$ shown in FIG. 2C. The corresponding example is given for $R=0.25\lambda$. Impedance distribution presented in FIG. 3B enables to reach a considerable AP drop in the direction to the local horizon, see FIG. 3A. For radii $R=0.5 \ldots 4\lambda$, characteristics were improved by using a radome design shown in FIG. 2B. The best embodiment was obtained when $R=2\lambda$. Impedance distributions and characteristics $|F(\theta)|$ and $DU(\theta)$ achieved are given in FIGS. 7B and 7A correspondingly.

FIG. 9 shows one of the radome embodiments. A semi-transparent area can contain one semi-transparent surface. To implement such a semi-transparent surface with the user-defined impedance distribution, a metal surface 91 is selected with a set of slots 92, to which elements with user-defined impedance, such as inductors, capacitors, and/or resistors, are connected. Discrete elements not shown in the figure. 93 is a regular patch antenna. Different embodiments of such a semi-transparent surface are shown in FIGS. 10A-10C. Examples of these elements are shown in FIGS. 11A-11G.

Figure 11A:
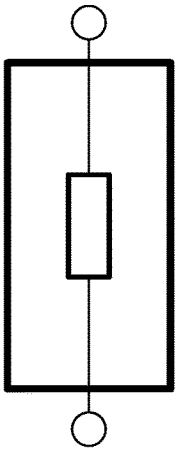
Figure 11B:
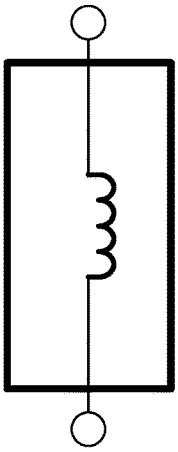
Figure 11C:
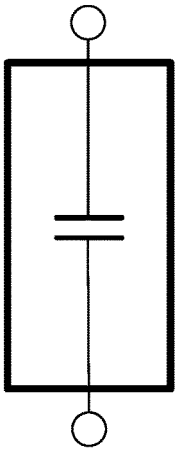
Figure 11D:
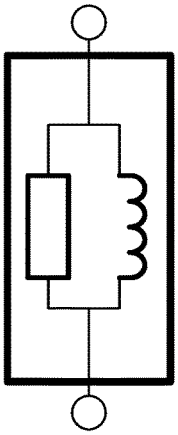
Figure 11E:
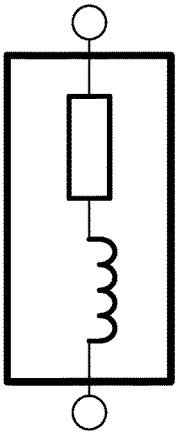
Figure 11F:
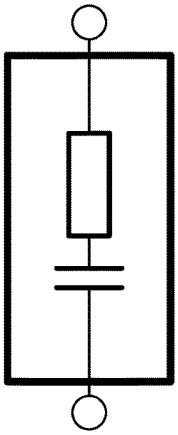
Figure 11G:
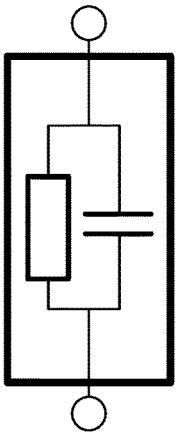

FIG. 10A shows a semi-transparent surface 101 with a set of horizontally-located slots 1011. FIG. 10B presents a semi-transparent surface 102 with a set of vertically-located/vertical slots 1021, and FIG. 10C shows a semi-transparent surface 103 with a set of both horizontal slots 1031 and vertical slots 1032. All these slots are connected to elements 104 with user defined impedance. FIGS. 11A-11C present examples of implementing elements 104. These elements can contain resistors, inductors, capacitors and their connections (serial or parallel).

Both lumped and shared-circuit elements can be used as capacitors, resistors and inductors. Nominal values of these elements are selected based on the condition of suppressing field interference in the lower hemisphere at the required bandwidth.

The width of slots is defined by a convenient installation of elements containing resistors, inductors and capacitors. For example, for lumped elements the width of the slot is determined by the size of the corresponding components.

The semi-transparent area can include several layers. The structure of each layer corresponds to the structure of semi-transparent surfaces shown in FIGS. 10A-10C. An example of implementing such areas is shown in FIG. 12, where 1201, 1202 and 1203 are the layers of the semi-transparent area. The layer can be made, for example, as a printed circuit board (PCB). Elements with user-defined impedance are not shown in the figure.

Below there are parameters of one radome embodiment, the use of which enable to reach $DU(\theta)$ ratio better than −20 dB starting from angle $\theta=12°$ in the lower hemisphere relative to the horizon.

$$R=2\lambda, \theta_1=0.52\pi, \theta_2=0.74\pi, Z_S=-i0.5W_0,$$

where R is the radius of the spherical radome, $\theta_1$, $\theta_2$ are the angles in terms of FIG. 2B, $Z_S$ is the impedance of the semi-transparent area.

FIG. 13 shows an embodiment for antenna system design having only horizontal slots 131. Discrete elements not shown in the figure. 132 is a regular patch antenna.

FIG. 14 shows an embodiment for antenna system design having only vertical slots. Discrete elements not shown in the figure. 142 is a regular patch antenna.

FIG. 15 shows a segment of semi-transparent surface. Parameters of an embodiment in terms of FIG. 2A and FIG. 2B: semi-spherical radome; R=380 mm; $\Theta_1=88°$; $\Theta_2=97°$; $Z_S=i0.6W_0$. The radome is a PCB board having metallization only on one side of the board. The width 153 of the semi-transparent segment is 60 mm. The semi-transparent segment includes a set of horizontal slots 151 each 1 mm in width. The distance 155 between two adjusted slots is 4 mm. There is a set of 8.2 nH inductors 152 connected to each slot. The distance 154 between adjusted inductors along a slot is 10 mm.

Having thus described a preferred embodiment, it should be apparent to those skilled in the art that certain advantages of the described method and system have been achieved. It should also be appreciated that various modifications, adaptations, and alternative embodiments thereof may be made within the scope and spirit of the present invention. The invention is further defined by the following claims.

What is claimed is:

1. An antenna system comprising:

a circularly-polarized antenna element with a Down/Up ratio between 0° and 12° relative to a local horizon of no better than −12 dB, and an antenna radome providing a Down/Up ratio of −20 dB or better starting from 12° and having transparent and semi-transparent areas, the transparent area being above the semi-transparent area.

2. The antenna system of claim 1, wherein the semi-transparent area contains multiple parts having different degrees of transparence.

3. The antenna system of claim 2, wherein each part of the semi-transparent area includes a set of slots with a specified impedance.

4. The antenna system of claim 3, wherein the semi-transparent area can comprise a set of vertical slots and a set of horizontal slots.

5. The antenna system of claim 4, wherein the radome includes a plurality of discrete elements providing the specified impedance.

6. The antenna system of claim 5, wherein the discrete elements include any of capacitors, inductors, resistors, connected in series and/or in parallel.

7. The antenna system of claim 1, wherein the semi-transparent area has a plurality of layers, each layer having a set of vertical slots and a set of horizontal slots.

8. An antenna system comprising:

a circularly-polarized antenna element with a Down/Up ratio between 0° and 12° relative to a local horizon of no better than −12 dB, and an antenna radome enclosing the antenna element, the radome providing a Down/Up ratio of −20 dB or better starting from 12° and having an upper transparent area and a lower semi-transparent area, wherein the semi-transparent area is has a generally hemispherical shape, and wherein the semi-transparent area includes a circular metallized portion with vertical and horizontal slots, the metallized portion extending part of the way downward from an equator of the generally hemispherical shape, and wherein the metallized portion includes passive discrete elements connected across at least some of the slots, and wherein the metallized portion has a plurality of circular rows separated by the horizontal slots.

9. The antenna system of claim 8, wherein the metallized portion includes multiple areas having different degrees of transparence.

10. The antenna system of claim 9, wherein each area of the metallized portion has a specified impedance.

11. The antenna system of claim 8, wherein the discrete elements include any of capacitors, inductors, resistors, connected in series and/or in parallel.

* * * * *